US008179115B2

(12) United States Patent
Wang

(10) Patent No.: US 8,179,115 B2
(45) Date of Patent: May 15, 2012

(54) BANDGAP CIRCUIT HAVING A ZERO TEMPERATURE COEFFICIENT

(75) Inventor: Ling Wang, Jiangsu Province (CN)

(73) Assignee: Aicestar Technology (SuZhou) Corporation, Soochow (CN)

( * ) Notice: Subject to any disclaimer, the term of this patent is extended or adjusted under 35 U.S.C. 154(b) by 526 days.

(21) Appl. No.: 12/503,819

(22) Filed: Jul. 15, 2009

(65) Prior Publication Data

US 2011/0012581 A1 Jan. 20, 2011

(51) Int. Cl.
*G05F 3/16* (2006.01)
*G05F 1/40* (2006.01)

(52) U.S. Cl. ..... 323/313; 323/316; 323/281; 327/539

(58) Field of Classification Search ..... 323/312–317, 323/280, 281; 327/538–543
See application file for complete search history.

(56) References Cited

U.S. PATENT DOCUMENTS 6,407,622 B1 * 6/2002 Opris ..... 327/539
7,075,282 B2 * 7/2006 Feng ..... 323/313
7,636,009 B2 * 12/2009 Jo et al. ..... 327/539
7,667,448 B2 * 2/2010 Matsumoto et al. ..... 323/312
8,106,707 B2 * 1/2012 Katyal et al. ..... 327/539

OTHER PUBLICATIONS

Authored by Mok, et al., article titled "Design considerations of recent advanced low-voltage low-temperature-coefficient CMOS bandgap voltage reference," adopted from Custom Integrated Circuits Conference, 2004. Proceedings of the IEEE 2004, Volume , Issue , Oct. 3-6, 2004 pp. 635-642.
Authored by Banba, et al., article titled "A CMOS bandgap reference circuit with sub-1-V operation," adopted from Solid-State Circuits, IEEE Journal, vol. 34, Issue 5, May 1999 pp. 670-674.

* cited by examiner

*Primary Examiner* — Jessica Han
(74) *Attorney, Agent, or Firm* — Jianq Chyun IP Office

(57) ABSTRACT

A bandgap circuit is provided, which includes a current source, a voltage boost circuit, a voltage input circuit, a voltage equalizer circuit, and a voltage output circuit. The current source provides a first current, a second current, and a third current, which are equal to one another. The voltage boost circuit provides a boost voltage by a single current path. The voltage input circuit receives the first and the second currents, and provides a first input voltage and a second input voltage based on the boost voltage. The voltage equalizer circuit receives the first and the second input voltages and equalize the two input voltages. The voltage output circuit provides a bandgap reference voltage according to the third current.

15 Claims, 7 Drawing Sheets

BANDGAP CIRCUIT HAVING A ZERO TEMPERATURE COEFFICIENT

BACKGROUND OF THE INVENTION

1. Field of the Invention

The present invention relates to a bandgap circuit. More particularly, the present invention relates to a bandgap circuit of a current mode and a voltage mode.

2. Description of Related Art

A bandgap circuit is used for generating a stable reference voltage that is not influenced by temperature variation. FIG. 1 is a circuit diagram illustrating a conventional current mode bandgap circuit. In which, metal oxide semiconductor field effect transistors (MOS transistors) M1, M2 and M3 form a current mirror to equalize currents I1, I2 and I3. Two input terminals of an operation amplifier OPA respectively receive input voltages $V_{IN}$ and $V_{IP}$, and the input voltages $V_{IN}$ and $V_{IP}$ can be equalized by a virtual short circuit effect of the operation amplifier OPA. Resistors R1 and R3 have a same resistance, and the input voltages $V_{IN}$ and $V_{IP}$ are equal, so that currents flowing through the resistors R1 and R3 are the same, and accordingly currents flowing through bipolar junction transistors (BJTs) Q1 and Q2 are the same. As shown in FIG. 1, a size of the BJT Q2 is x times greater than that of the BJT Q1, in this case, a voltage difference between emitters of the BJTs Q1 and Q2 is $V_T$LnX. Wherein, $V_T$ presents a thermal voltage, and $V_T$=kT/q, wherein k is a Boltzmann's constant, T represents a current absolute temperature, and q represents a quantity of electrical charge $1.6\times10^{-19}$ coulombs, and Ln represents a natural logarithm. Namely, a voltage formed between two ends of the resistor R2 is $V_T$LnX.

According to the above conditions, an amount of the current I2 is $(V_T\text{LnX})/R2+V_{EB1}/R3$, wherein $V_{EB1}$ represents a voltage between the emitter and a base of the BJT Q1. Since the currents I2 and I3 are the same, a bandgap reference voltage VBG provided by the circuit of FIG. 1 is $[(V_T\text{LnX})/R2+V_{EB1}/R3]*R4$. The thermal voltage $V_T$ has a positive temperature coefficient, and the voltage $V_{EB1}$ has a negative temperature coefficient. As long as values of X, R2 and R3 are suitably designed, the positive temperature coefficient and the negative temperature coefficient can be counteracted, so that the currents I1, I2 and I3 are not influenced by the temperature variation, and accordingly the bandgap reference voltage VBG is not influenced by the temperature variation.

The operation amplifier OPA can apply an NMOS transistor input structure as that shown in FIG. 2, and can also apply a PMOS transistor input structure as that shown in FIG. 3. Regarding the NMOS transistor input structure of FIG. 2, the input voltages $V_{IN}$ and $V_{IP}$ has to be great enough to normally operate the operation amplifier OPA. Namely, a following condition has to be satisfied:

$$V_{EB1}>V_{THN}+V_{DS15}$$

Wherein, $V_{THN}$ is a threshold voltage of an NMOS transistor M11, and $V_{DS15}$ is a voltage between a drain and a source of an NMOS transistor M15 when the NMOS transistor M15 is operated in a saturation region. A problem is that if the threshold voltage $V_{THN}$ is too high, within a system temperature range, the threshold voltage $V_{THN}$ is probably greater than the input voltage $V_{EB1}$ throughout, so that the operation amplifier OPA is unable to work.

On the other hand, regarding the PMOS transistor input structure of FIG. 3, a supply power PCC has to be great enough to normally operate the operation amplifier OPA. Namely, a following condition has to be satisfied:

$$VCC>=V_{EB1}+|V_{THP}|+V_{DS15}$$

Wherein, $V_{THP}$ is a threshold voltage of a PMOS transistor M11. As a fabrication process of a present semiconductor circuit becomes finer, the supply power VCC is accordingly decreased. If the threshold voltage $|V_{THP}|$ is too high, within the system temperature range, $V_{EB1}+|V_{THP}|$ is probably greater than the supply voltage VCC throughout, so that the operation amplifier OPA is unable to work.

FIG. 4 is a circuit diagram illustrating another conventional current mode bandgap circuit. To resolve the working problem of the aforementioned operation amplifier OPA, resistors R5 and R6 are further applied to the bandgap circuit of FIG. 4 to promote the input voltages $V_{IN}$ and $V_{IP}$ of the operation amplifier OPA. Resistances of the resistors R5 and R6 are the same, and by using the operation amplifier OPA of the NMOS transistor input structure, as long as the input voltages $V_{IN}$ and $V_{IP}$ are promoted to be greater than $V_{THN}+V_{DS15}$, the operation amplifier OPA can normally work. However, since variation of the fabrication process cannot be totally controlled, the PMOS transistors M1 and M2 of the current mirror are probably not totally matched, so that the current I1 is slightly different to the current I2, and the resistors R5 and R6 are probably not totally matched. The above unmatched problem can result in a difference between the two input voltages $V_{IN}$ and $V_{IP}$ of the operation amplifier OPA, which may bring an adverse effect to the bandgap reference voltage VBG.

SUMMARY OF THE INVENTION

The present invention is directed to a bandgap circuit, which can normally work under an environment of a high threshold voltage and a low supply voltage, and can provide a stable bandgap reference voltage that is not influenced by temperature variation, so that an adverse effect caused by unmatched fabrication process can be mitigated.

The present invention provides a bandgap circuit including a current source, a voltage boost circuit, a voltage input circuit, a voltage equalizer circuit, and a voltage output circuit. The current source provides a first current, a second current, and a third current, which are equal to one another. The voltage boost circuit provides a boost voltage by a single current path. The voltage input circuit is coupled to the voltage boost circuit and the current source for receiving the first and the second currents, and providing a first input voltage and a second input voltage based on the boost voltage. The voltage equalizer circuit is coupled to the voltage input circuit for receiving the first and the second input voltages, and equalizing the two input voltages. The voltage output circuit is coupled to the current source for providing a bandgap reference voltage according to the third current.

The voltage boost circuit includes a resistor coupled between the voltage input circuit and ground. The resistor forms the current path and provides the boost voltage.

In an embodiment of the present invention, the voltage input circuit makes the second current to have a zero temperature coefficient, which means the second current is not influenced by temperature variation. In another embodiment of the present invention, the voltage input circuit makes the second current to have a positive temperature coefficient.

In case that the second current has the positive temperature coefficient, the voltage input circuit includes a first and a second bipolar junction transistor (BJT) and a resistor. An emitter of the first BJT is coupled to the current source, and receives the first current, and a base of the first BJT is coupled to the single current path of the voltage boost circuit. The resistor is coupled to the current source, and receives the second current. An emitter of the second BJT is coupled to the resistor, and a base of the second BJT is coupled to the single current path of the voltage boost circuit. A coupling node of the first BJT and the current source provides the first input voltage, and a coupling node of the resistor and the current source provides the second input voltage. Collectors of the first and the second BJTs are all coupled to the single current path of the voltage boost circuit, or coupled to the ground.

The voltage output circuit includes a resistor and a voltage compensation circuit. The resistor is coupled to the current source, and receives the third current. A coupling node of the resistor and the current source provides the bandgap reference voltage. The voltage compensation circuit is coupled between the resistor and the ground, and provides a compensation voltage having a negative temperature coefficient, so that the bandgap reference voltage may have a zero temperature coefficient. The voltage compensation circuit includes a BJT, wherein an emitter of the BJT is coupled to the resistor, and a base and a collector of the BJT are coupled to the ground.

The aforementioned bandgap circuit uses the single current path to promote the first input voltage and the second input voltage, so that the bandgap circuit can normally work under an environment of a high threshold voltage and a low supply voltage, and can provide a stable bandgap reference voltage that is not influenced by temperature variation. Since the single current path is used, unmatched problem of two resistors of the related art can be avoided, so that an adverse effect caused by unmatched fabrication process can be mitigated.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 5:
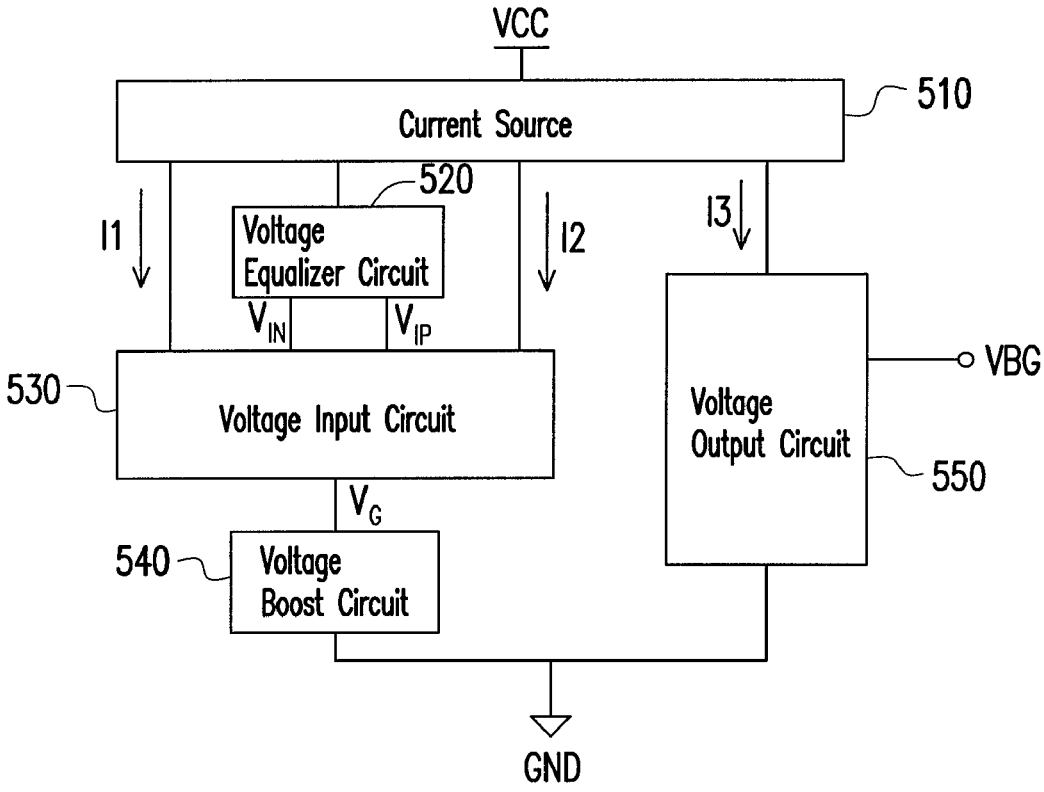
FIG. 5 is a schematic diagram illustrating a bandgap circuit according to an embodiment of the present invention.

FIG. 5 is a schematic diagram illustrating a bandgap circuit according to an embodiment of the present invention. The bandgap circuit of FIG. 5 includes a current source 510, a voltage equalizer circuit 520, a voltage input circuit 530, a voltage boost circuit 540, and a voltage output circuit 550. The current source 510 provides three currents I1, I2 and I3, and maintains values of the three currents to a fixed ratio. For example, the currents I1, I2 and I3 can be equal, namely, I1:I2:I3=1:1:1. The voltage boost circuit 540 provides a boost voltage $V_G$ by a single current path. The voltage input circuit 530 is coupled to the voltage boost circuit 540, the voltage equalizer circuit 520, and the current source 510. The voltage input circuit 530 receives the currents I1 and I2, and provides input voltages $V_{IN}$ and $V_{IP}$ based on the boost voltage $V_G$. The voltage equalizer circuit 520 is coupled to the current source 510 and the voltage input circuit 530, and receives the input voltages $V_{IN}$ and $V_{IP}$, and controls the current source 510 to substantially approach (equalize) the two input voltages $V_{IN}$ and $V_{IP}$. The voltage output circuit 550 is coupled to the current source 510 for providing a bandgap reference voltage VBG that is not influenced by temperature variation according to the current I3.

Figure 6:
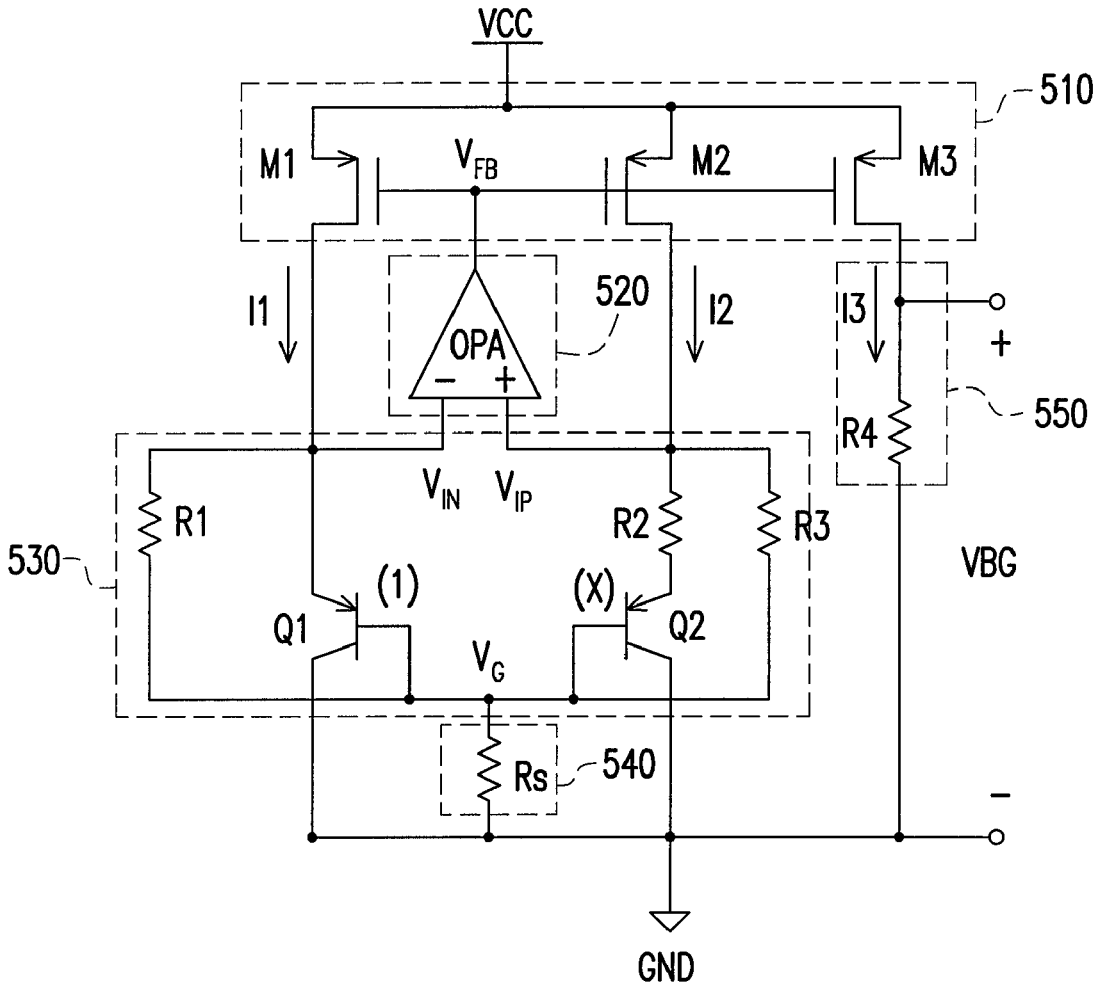
FIG. 6-8 are circuit diagrams respectively illustrating three bandgap circuits according to an embodiment of the present invention.
Figure 7:
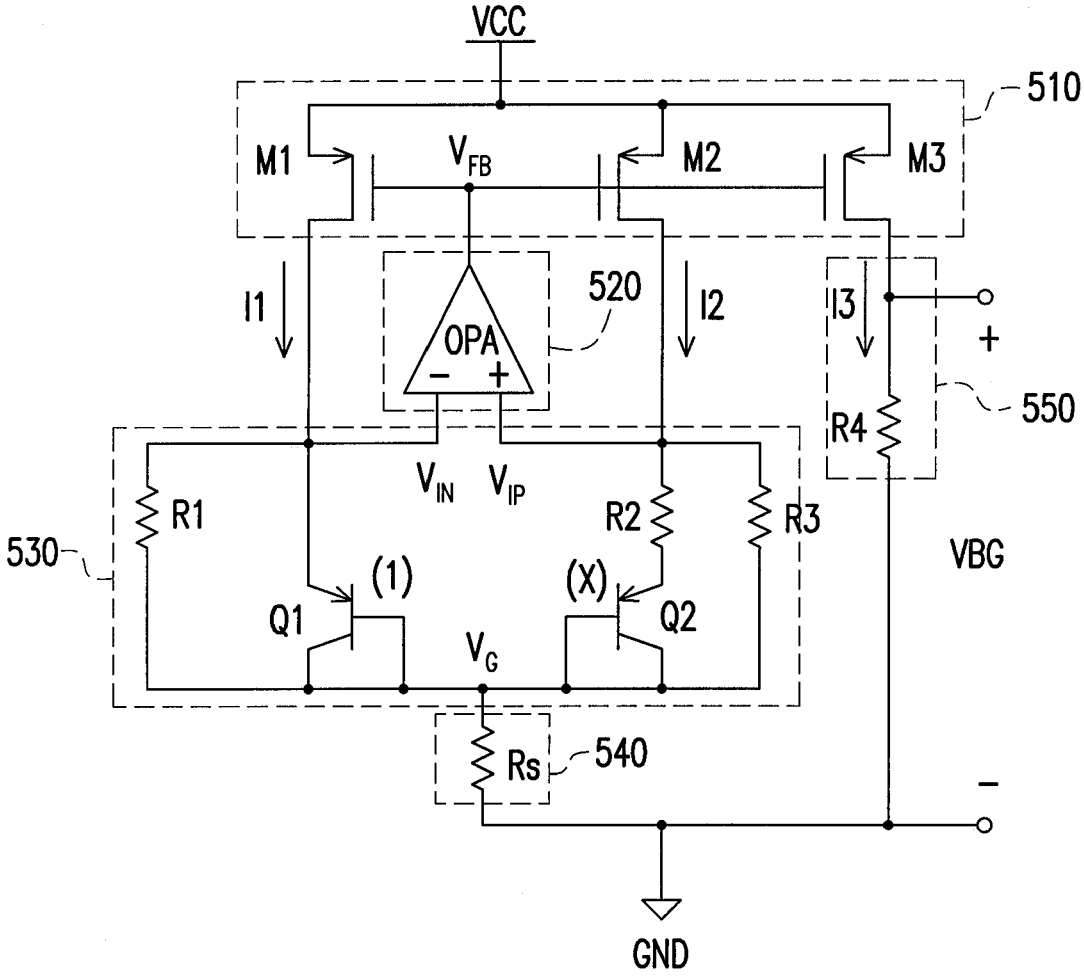
Figure 8:
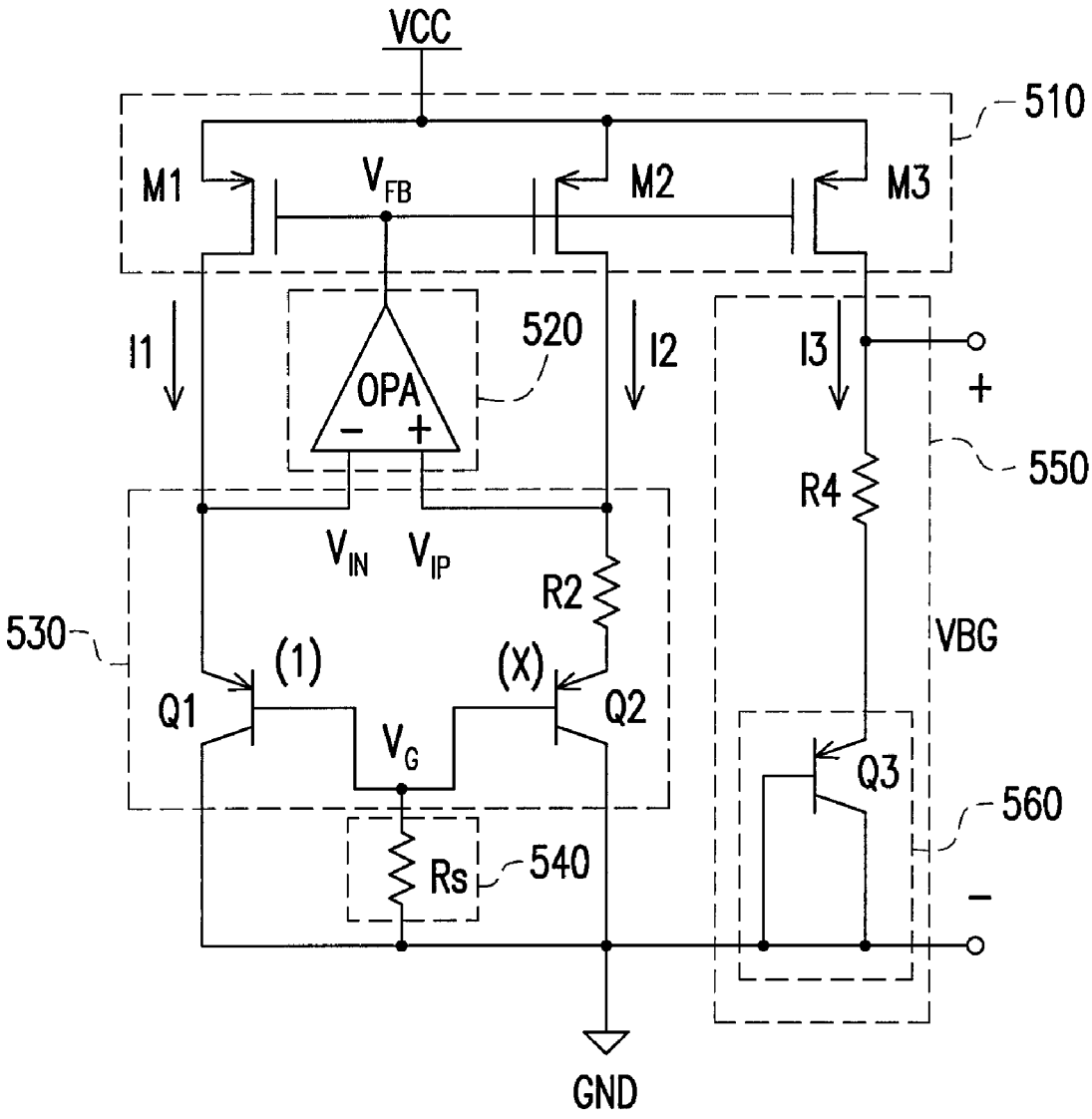

FIGS. 6-8 are circuit diagrams illustrating three circuit designs of the bandgap circuit of FIG. 5, wherein current mode bandgap circuits are illustrated in FIG. 6 and FIG. 7, and a voltage mode bandgap circuit is illustrated in FIG. 8. In the circuit of FIG. 6, the current source 510 includes a current mirror formed by PMOS transistors M1, M2 and M3. The current mirror is coupled to the voltage input circuit 530 and the voltage output circuit 550 for receiving a supply voltage VCC and providing the equivalent currents I1, I2 and I3. The voltage equalizer circuit 520 includes an operation amplifier OPA. Two input terminals of the operation amplifier OPA are coupled to the voltage input circuit 530 for respectively receiving the input voltages $V_{IN}$ and $V_{IP}$. An output terminal of the operation amplifier OPA is coupled to the PMOS transistors M1, M2 and M3 that form the current mirror. The voltage boost circuit 540 includes a resistor Rs coupled between the voltage input circuit 530 and ground GND. The resistor Rs forms the aforementioned single current path, and provides the boost voltage $V_G$.

Besides providing the input voltages $V_{IN}$ and $V_{IP}$, another function of the voltage input circuit 530 of FIG. 6 is to make the current I2 to have a zero temperature coefficient. Namely, the current I2 is not influence by the temperature variation. Under a function of the current mirror of the current source 510, the currents I1, I2 and I3 are all not influenced by the temperature variation, and accordingly the bandgap reference voltage VBG is also not influenced by the temperature variation.

The voltage input circuit 530 of FIG. 6 includes resistors R1, R2 and R3, and bipolar junction transistors (BJTs) Q1 and Q2. One end of the resistor R1 is coupled to the PMOS transistor M1 and the operation amplifier OPA, and receives the current I1, and another end of the resistor R1 is coupled to the resistor Rs. An emitter of the BJT Q1 is coupled to the PMOS transistor M1, the operation amplifier OPA and the resistor R1, and receives the current I1, a base of the BJT Q1 is coupled to the resistor Rs, and a collector of the BJT Q1 is coupled to the ground GND. The resistor R2 is coupled to the PMOS transistor M2 and the operation amplifier OPA, and receives the current I2. An emitter of the BJT Q2 is coupled to the resistor R2, a base of the BJT Q2 is coupled to the resistor Rs, and a collector of the BJT Q2 is coupled to the ground. One end of the resistor R3 is coupled to the PMOS transistor M2, the operation amplifier OPA and the resistor R2, and receives the current I2, and another end of the resistor R3 is coupled to the resistor Rs. The resistors R1 and R3 have a same resistance. A coupling node of the resistor R1 and the emitter of the BJT Q1 provides the input voltage $V_{IN}$, and a coupling node of the resistors R2 and R3 provides the input voltage $V_{IP}$.

The voltage output circuit 550 of FIG. 6 includes a resistor R4. The resistor R4 is coupled between the PMOS transistor M3 and the ground GND, and receives the current I3. A coupling node of the resistor R4 and the PMOS transistor M3 provides the bandgap reference voltage VBG. Since the current I3 has the zero temperature coefficient, the bandgap reference voltage VBG also has the zero temperature coefficient.

Figure 1:
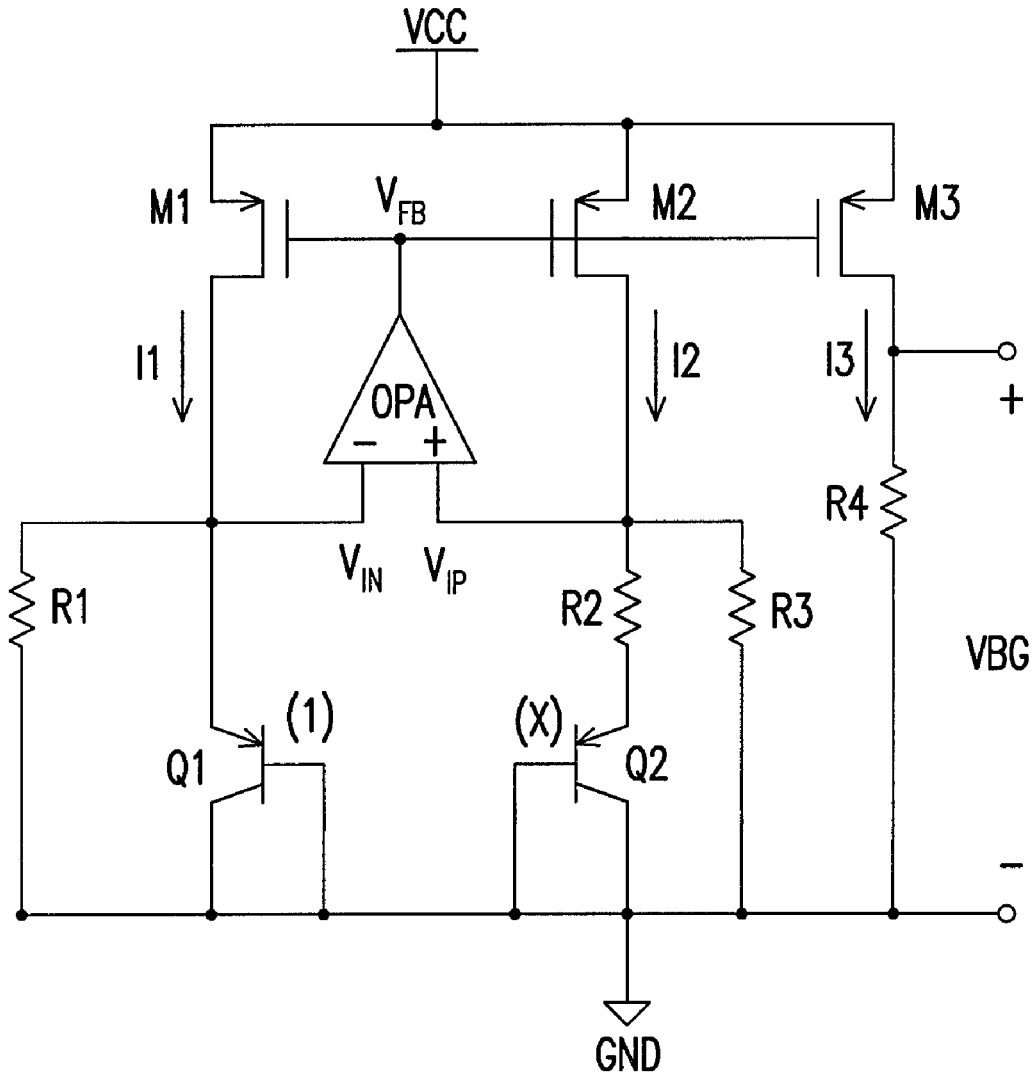
FIG. 1 (RELATED ART)
FIG. 1 is a circuit diagram illustrating a conventional current mode bandgap circuit.
Figure 2:
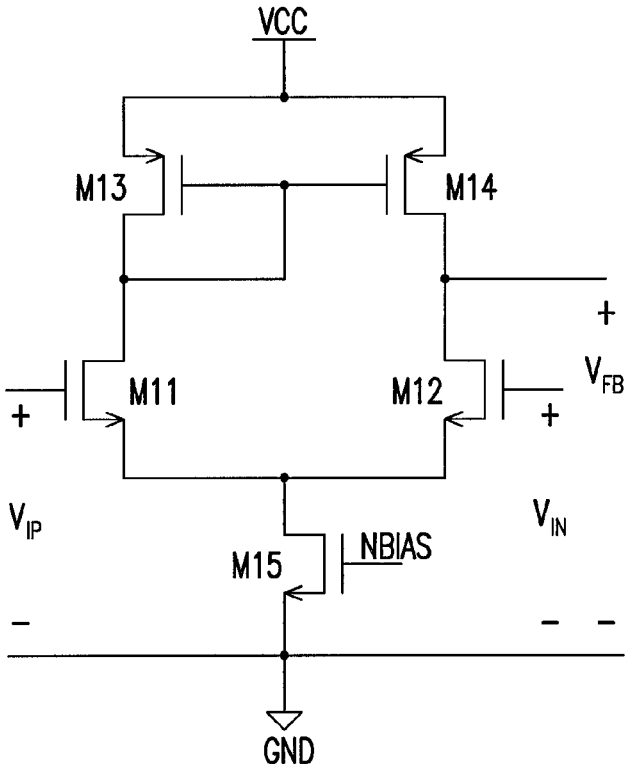
FIG. 2 (RELATED ART)
FIG. 2 and FIG. 3 are circuit diagrams illustrating two conventional operation amplifiers.
Figure 3:
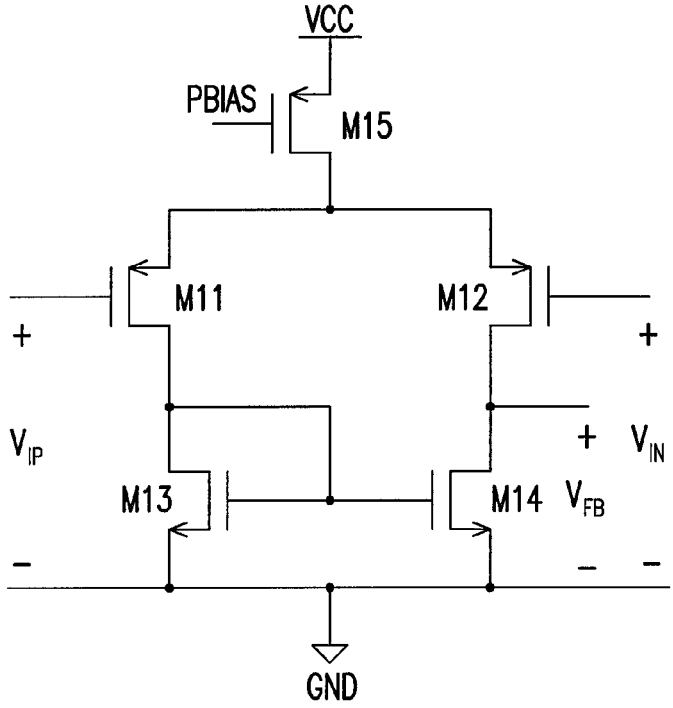
FIG. 3 (RELATED ART)
Figure 4:
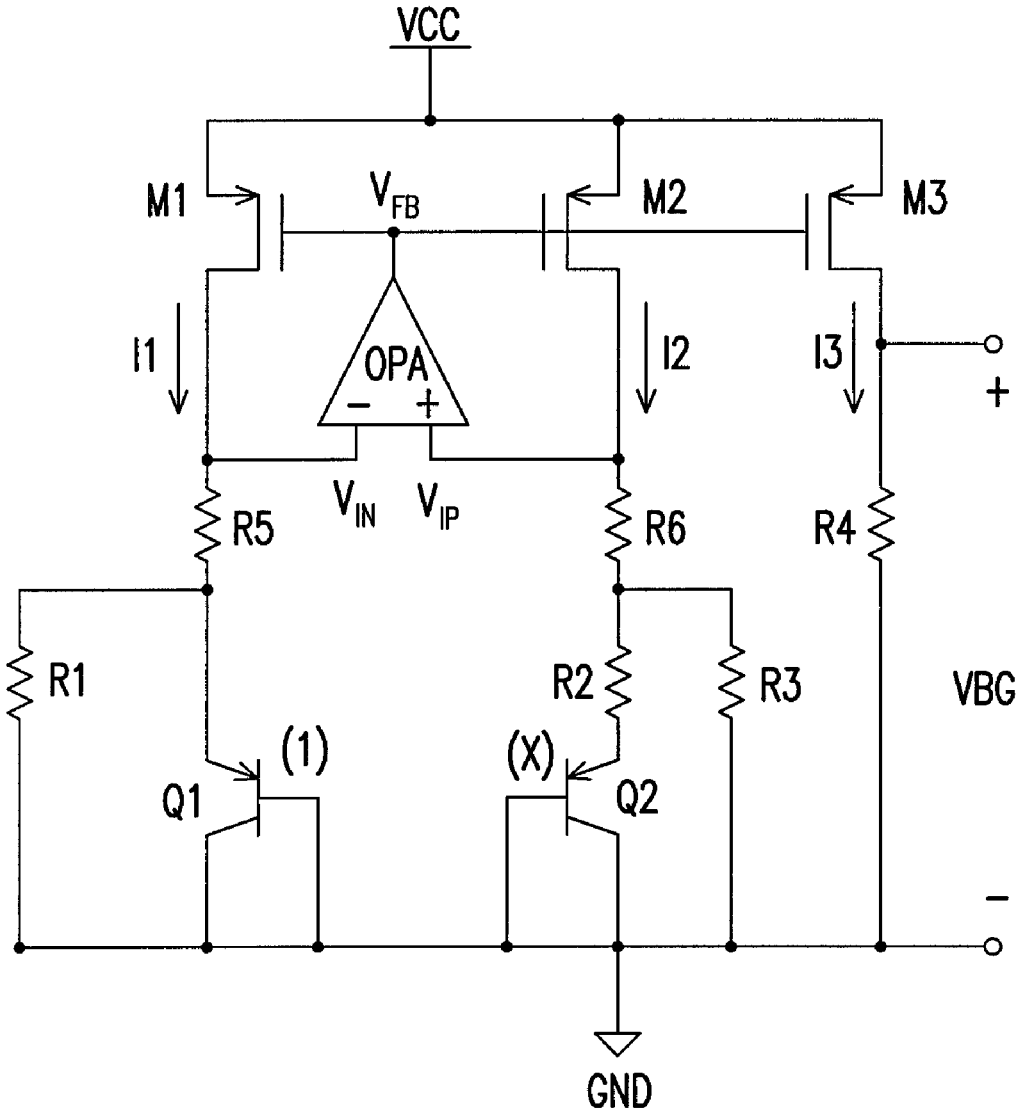
FIG. 4 (RELATED ART)
FIG. 4 is a circuit diagram illustrating another conventional current mode bandgap circuit.

A main difference between the bandgap circuit of FIG. 6 and the conventional bandgap circuit of FIG. 1 is that the resistor Rs is applied. The resistor Rs provides the boost voltage $V_G$, so that the input voltages $V_{IN}$ and $V_{IP}$ formed based on the boost voltage $V_G$ are promoted. The operation amplifier OPA of FIG. 6 applies the N-type metal oxide semiconductor field effect (NMOS) transistor input structure as that shown in FIG. 2. As long as the resistance of the resistor Rs is suitably designed, the input voltages $V_{IN}$ and $V_{IP}$ can be greater than $V_{THN}+V_{DS15}$, so that the operation amplifier OPA can normally operate under an environment of a high threshold voltage and a low supply voltage. Since the bandgap circuit of FIG. 6 only uses one resistor Rs to promote the input voltages $V_{IN}$ and $V_{IP}$, the unmatched problem of the two resistors R5 and R6 in the conventional bandgap circuit of FIG. 4 can be avoided, so that an adverse effect of the bandgap reference voltage VBG caused by unmatched fabrication process can be effectively mitigated.

FIG. 7 is a diagram illustrating another design of the bandgap circuit of FIG. 5. A difference between FIG. 7 and FIG. 6 is that the collectors of the BJTs Q1 and Q2 are all coupled to the resistor Rs instead of coupling to the ground GND. Such variation does not influence a performance of the bandgap circuit of FIG. 7.

FIG. 8 is a diagram illustrating still another design of the bandgap circuit of FIG. 5. In the voltage input circuit 530 of FIG. 8, the resistors R1 and R3 are omitted, so that the currents I1, I2 and I3 output from the current source 510 all have a positive temperature coefficient. To counteract the positive temperature coefficient of the current I3, the voltage output circuit 550 of FIG. 8 can include the resistor R4 and a voltage compensation circuit 560. The resistor R4 is coupled to the PMOS transistor M3, and receives the current I3. The coupling node of the resistor R4 and the PMOS transistor M3 provides the bandgap reference voltage VBG. The voltage compensation circuit 560 is coupled between the resistor R4 and the ground GND for providing a compensation voltage having a negative temperature coefficient. The negative temperature coefficient of the compensation voltage is counteracted to the positive temperature coefficient of the current I3, so that the bandgap reference voltage VBG may have the zero temperature coefficient and is not influenced by the temperature variation. The voltage compensation circuit 560 includes a BJT Q3, wherein an emitter of the BJT Q3 is coupled to the resistor R4, and a base and a collector of the BJT Q3 are all coupled to the ground GND. The compensation voltage is a voltage between the emitter and the base of the BJT Q3.

In summary, the single current path formed by a single resistor is used to promote the input voltages of the operation amplifier of the NMOS transistor input structure, so that the bandgap circuit can normally work under an environment of a high threshold voltage and a low supply voltage, and can provide a stable bandgap reference voltage that is not influenced by temperature variation. Since the single resistor is used to promote the input voltages of the operation amplifier, the unmatched problem of two resistors of the related art can be avoided, so that an adverse effect caused by unmatched fabrication process can be mitigated.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A bandgap circuit, comprising:

a current source, providing a first current, a second current, and a third current;

a voltage boost circuit, providing a boost voltage by a single current path;

a voltage input circuit, coupled to the voltage boost circuit and the current source, receiving the first current and the second current, and providing a first input voltage and a second input voltage based on the boost voltage;

a voltage equalizer circuit, coupled to the voltage input circuit, receiving the first input voltage and the second input voltage, and equalizing the first input voltage to the second input voltage; and a voltage output circuit, coupled to the current source, and providing a bandgap reference voltage according to the third current.

2. The bandgap circuit as claimed in claim 1, wherein the current source comprises a current mirror coupled to the voltage input circuit and the voltage output circuit, and the current mirror receives a supply voltage and provides the first current, the second current and the third current.

3. The bandgap circuit as claimed in claim 1, wherein the voltage boost circuit comprises a resistor coupled between the voltage input circuit and ground, and the resistor forms the single current path and provides the boost voltage.

4. The bandgap circuit as claimed in claim 1, wherein the voltage equalizer circuit comprises an operation amplifier, two input terminals of the operation amplifier are coupled to the voltage input circuit for respectively receiving the first input voltage and the second input voltage, and an output terminal of the operation amplifier is coupled to the current source.

5. The bandgap circuit as claimed in claim 4, wherein the operation amplifier applies an N-type metal oxide semiconductor field effect (NMOS) transistor input structure.

6. The bandgap circuit as claimed in claim 1, wherein the voltage input circuit makes the second current to have a zero temperature coefficient.

7. The bandgap circuit as claimed in claim 6, wherein the voltage input circuit comprises:

a first resistor, coupled between the current source and the single current path of the voltage boost circuit, and receiving the first current;

a first bipolar junction transistor (BJT), having an emitter coupled to the first resistor and the current source for receiving the first current, and a base coupled to the single current path of the voltage boost circuit;

a second resistor, coupled to the current source, and receiving the second current;

a second BJT, having an emitter coupled to the second resistor, and a base coupled to the single current path of the voltage boost circuit; and a third resistor, having a first end coupled to the second resistor and the current source for receiving the second current, and a second end coupled to the single current path of the voltage boost circuit, wherein a coupling node of the first resistor and the emitter of the first BJT provides the first input voltage, and a coupling node of the second resistor and the third resistor provides the second input voltage.

8. The bandgap circuit as claimed in claim 7, wherein the first resistor and the third resistor have a same resistance.

9. The bandgap circuit as claimed in claim 7, wherein collectors of the first BJT and the second BJT are all coupled to the single current path of the voltage boost circuit.

10. The bandgap circuit as claimed in claim 7, wherein collectors of the first BJT and the second BJT are all coupled to ground.

11. The bandgap circuit as claimed in claim 6, wherein the voltage output circuit comprises a resistor, the resistor is coupled between the current source and ground and receives the third current, and a coupling node of the resistor and the current source provides the bandgap reference voltage having the zero temperature coefficient.

12. The bandgap circuit as claimed in claim 1, wherein the voltage input circuit makes the second current to have a positive temperature coefficient.

13. The bandgap circuit as claimed in claim 12, wherein the voltage input circuit comprises:

a first BJT, having an emitter coupled to the current source and receiving the first current, and a base coupled to the single current path of the voltage boost circuit;

a resistor, coupled to the current source, and receiving the second current; and a second BJT, having an emitter coupled to the resistor, and a base coupled to the single current path of the voltage boost circuit, wherein a coupling node of the first BJT and the current source provides the first input voltage, and a coupling node of the resistor and the current source provides the second input voltage.

14. The bandgap circuit as claimed in claim 12, wherein the voltage output circuit comprises:

a resistor, coupled to the current source for receiving the third current, and a coupling node of the resistor and the current source providing the bandgap reference voltage; and a voltage compensation circuit, coupled between the resistor and ground, and providing a compensation voltage having a negative temperature coefficient, so that the bandgap reference voltage has the zero temperature coefficient.

15. The bandgap circuit as claimed in claim 14, wherein the voltage compensation circuit comprises a BJT, an emitter of the BJT is coupled to the resistor, and a base and a collector of the BJT are all coupled to the ground.

* * * * *